US011698173B2

(12) United States Patent
Chen et al.

(10) Patent No.: US 11,698,173 B2
(45) Date of Patent: Jul. 11, 2023

(54) CEILING LAMP

(71) Applicants: SUZHOU OPPLE LIGHTING CO., LTD., Suzhou (CN); OPPLE LIGHTING CO., LTD., Shanghai (CN)

(72) Inventors: Hongwei Chen, Suzhou (CN); Zhanhua Chen, Suzhou (CN); Guolong Ni, Suzhou (CN); Caibao Tang, Suzhou (CN)

(73) Assignees: Suzhou Opple Lighting Co., Ltd., Suzhou (CN); Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/563,027

(22) Filed: Dec. 27, 2021

(65) Prior Publication Data

US 2022/0136666 A1 May 5, 2022

Related U.S. Application Data

(63) Continuation of application No. PCT/CN2020/119237, filed on Sep. 30, 2020.

(30) Foreign Application Priority Data

Oct. 12, 2019 (CN) ..... 201910969562.X
Oct. 12, 2019 (CN) ..... 201921713420.9
Oct. 12, 2019 (CN) ..... 201921719616.9

(51) Int. Cl.
*F21S 8/04* (2006.01)
*F21V 17/16* (2006.01)
*F21V 21/03* (2006.01)

(52) U.S. Cl.
CPC ..... *F21S 8/043* (2013.01); *F21V 17/16* (2013.01); *F21V 21/03* (2013.01)

(58) Field of Classification Search
CPC ... F21S 8/043; F21S 8/02; F21S 8/026; F21V 17/16; F21V 17/162; F21V 21/03
See application file for complete search history.

(56) References Cited

U.S. PATENT DOCUMENTS 10,539,273 B1 * 1/2020 Cai ..... F21V 15/01
2010/0142202 A1 * 6/2010 Sugishita ..... F21V 7/0083 362/249.1
2016/0356462 A1 12/2016 O'Brien et al.

FOREIGN PATENT DOCUMENTS

CN 107906435 A 4/2018
CN 207880636 U 9/2018
(Continued)

OTHER PUBLICATIONS

Machine translation of FR 2704302 (Year: 1994).*
(Continued)

*Primary Examiner* — Leah Simone Macchiarolo
(74) *Attorney, Agent, or Firm* — Arch & Lake LLP

(57) ABSTRACT

A ceiling lamp, including a chassis, a frame assembly and an assembling assembly; the chassis is provided with an abutting surface bonded to a ceiling, and the frame assembly is detachably connected to the chassis in a vertical direction by the assembling assembly; the assembling assembly includes a first assembling member and a second assembling member, one of the first assembling member and the second assembling member is arranged on the chassis, and the other assembling member is correspondingly arranged on the frame assembly; a snap-fit groove is arranged in a side surface parallel to the vertical direction of the snap-fit main body, the snap-fit member is slidably arranged on the sliding base and is capable of protruding out of the sliding base to extend into the snap-fit groove, and the elastic element
(Continued)

supplies an elastic pushing force for the snap-fit member to extend into the snap-fit groove.

9 Claims, 6 Drawing Sheets

(56) References Cited

FOREIGN PATENT DOCUMENTS

| | | | | | |
|---|---|---|---|---|---|
| CN | 208519614 | U | | 2/2019 | |
| CN | 209068337 | U | | 7/2019 | |
| CN | 110630941 | A | | 12/2019 | |
| CN | 210462750 | U | | 5/2020 | |
| CN | 210462751 | U | | 5/2020 | |
| CN | 210717214 | U | | 6/2020 | |
| FR | 2704302 | A1 | * | 10/1994 | ..... E04B 9/006 |

OTHER PUBLICATIONS

Machine translation of CN207880636 (Year: 2018).*
International Search Report of PCT Application No. PCT/CN2020/119237 dated Jan. 5, 2021 with English translation, (6p).

* cited by examiner

CEILING LAMP

CROSS-REFERENCE TO RELATED APPLICATIONS

This application is based upon and claims the priority of PCT patent application No. PCT/CN2020/119237 filed on Sep. 30, 2020 which claims priority to the Chinese patent application No. 201910969562.X filed on Oct. 12, 2019, Chinese patent application No. 201921713420.9 filed on Oct. 12, 2019, and Chinese patent application No. 201921719616.9 filed on Oct. 12, 2019, the entire contents of which are hereby incorporated by reference herein for all purposes.

TECHNICAL FIELD

The present disclosure relates to the technical field of lighting, in particular to a ceiling lamp.

BACKGROUND

With the gradual improvement of people's living standard, a lamp has become a necessary electric appliance in people's daily lives and may play a role in supplying lighting for the environment. A ceiling lamp is a lighting lamp which has been widely used at present. The ceiling lamp is in a flat shape, its occupied layer height is small and the ceiling lamp is wide in lighting range so as to be widely popular with consumers.

SUMMARY

The present disclosure provides a ceiling lamp. The ceiling lamp includes a chassis, a frame assembly and an assembling assembly. The chassis is provided with an abutting surface bonded to a ceiling, and the frame assembly is detachably connected to the chassis in a vertical direction by the assembling assembly. The assembling assembly includes a first assembling member and a second assembling member, one of the first assembling member and the second assembling member is arranged on the chassis, and the other assembling member is correspondingly arranged on the frame assembly; the first assembling member comprises a snap-fit main body, the second assembling member comprises an elastic snap-fit assembly, and the elastic snap-fit assembly comprises a sliding base, an elastic element and a snap-fit member. A snap-fit groove is arranged in a side surface parallel to the vertical direction of the snap-fit main body, the snap-fit member is slidably arranged on the sliding base and is capable of protruding out of the sliding base to extend into the snap-fit groove, and the elastic element supplies an elastic pushing force for the snap-fit member to extend into the snap-fit groove.

It is to be understood that the foregoing general description and the following detailed description are exemplary and explanatory only and are not restrictive of the disclosure.

BRIEF DESCRIPTION OF THE DRAWINGS

The accompanying drawings illustrated herein are provided for further understanding of the present disclosure, and constitute a part of the present disclosure. Examples of the present disclosure and descriptions thereof are intended to explain the present disclosure, but do not constitute inappropriate limitations to the present disclosure. In the accompanying drawings.

Figure 1:
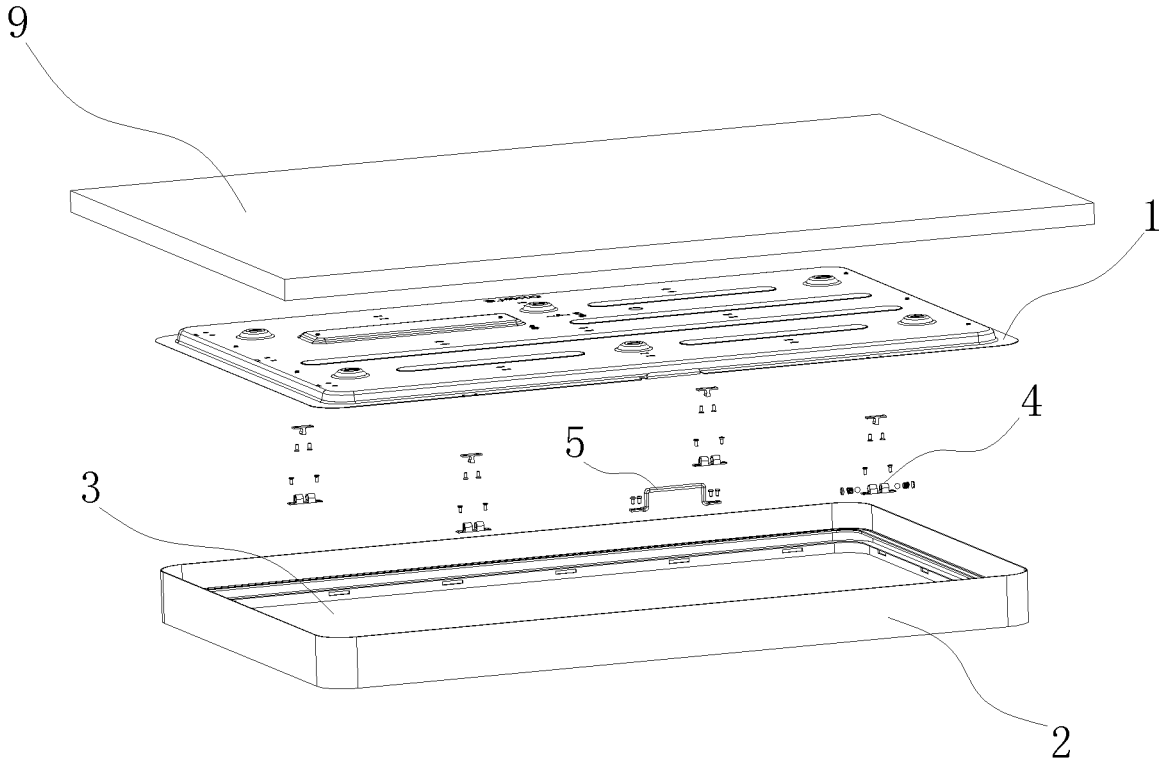
FIG. 1 is an exploded structural view of a ceiling lamp disclosed in one example of the present disclosure.

Description for Numerals in the Accompanying Drawings:

1-chassis, 10-pad foot, 100-abutting surface, 11-rib, 12-hooking part, 2-frame, 20-inner wall, 21-limiting member, 22-fixed member, 3-lampshade, 4-assembling assembly, 40-first assembling member, 400-snap-fit main body, 400*a*-snap-fit groove, 400*b*-guide surface, 401-connecting sheet, 41-second assembling member, 410-elastic snap-fit assembly, 410*a*-elastic element, 410*b*-snap-fit member, 410*c*-threaded end cover, 410*d*-sliding base/limiting cavity, 410*d*1-protrusion opening, 410*d*2-limiting body, 410*d*3-inlet, 412-fixed main body, S-hook, and 9-ceiling.

DETAILED DESCRIPTION

Examples of the present disclosure will be described below in combination with the accompanying drawings of the present disclosure. Apparently, the described examples are merely a part rather than all the examples of the present disclosure. All other examples that are derived from the examples of the present disclosure by an ordinary skilled in the art without creative efforts shall fall within the protection scope of the present disclosure. The reference numerals in the accompanying drawings are merely used to distinguish different steps in technical solutions from each other, rather than delimiting execution orders of the steps. The specific execution order may be referred to the description in the present disclosure.

Terms used in the present disclosure are merely for describing specific examples and are not intended to limit the present disclosure. The singular forms "one", "the", and "this" used in the present disclosure and the appended claims are also intended to include a multiple form, unless other meanings are clearly represented in the context. It should also be understood that the term "and/or" used in the present disclosure refers to any or all of possible combinations including one or more associated listed items.

Reference throughout this specification to "one embodiment," "an embodiment," "an example," "some embodiments," "some examples," or similar language means that a particular feature, structure, or characteristic described is included in at least one embodiment or example. Features, structures, elements, or characteristics described in connection with one or some embodiments are also applicable to other embodiments, unless expressly specified otherwise.

It should be understood that although terms "first", "second", "third", and the like are used in the present disclosure to describe various information, the information is not limited to the terms. These terms are merely used to differentiate information of a same type. For example, without departing from the scope of the present disclosure, first information is also referred to as second information, and similarly the second information is also referred to as the first information. Depending on the context, for example, the term "if" used herein may be explained as "when" or "while", or "in response to . . . , it is determined that".

Description for numerals in the accompanying drawings: 1-chassis, 10-pad foot, 100-abutting surface, 11-rib, 12-hooking part, 2-frame, 20-inner wall, 21-limiting member, 22-fixed member, 3-lampshade, 4-assembling assembly, 40-first assembling member, 400-snap-fit main body, 400*a*-snap-fit groove, 400*b*-guide surface, 401-connecting sheet, 41-second assembling member, 410-elastic snap-fit assembly, 410*a*-elastic element, 410*b*-snap-fit member, 410*c*-threaded end cover, 410*d*-sliding base/limiting cavity, 410*d*1-protrusion opening, 410*d*2-limiting body, 410*d*3-inlet, 412-fixed main body, S-hook, and 9-ceiling.

For a ceiling lamp in the related art, generally, a chassis is fixed to a ceiling firstly, and then, a frame assembly is fixedly connected to the chassis. The problem of maintenance or replacement of a light source, an optical element and even a driving element will be encountered in the use process of the ceiling lamp, and therefore, the frame assembly is generally connected to the chassis by a detachable structure.

However, although the frame assembly in the related art may be disassembled from the chassis, the disassembling process is generally troublesome due to the structural restriction of a detachable connecting member, and thus, the disassembling and assembling efficiency is lower.

An example of the present disclosure discloses a ceiling lamp, as shown in FIG. 1 to FIG. 12, including a chassis 1, a frame assembly composed of a frame 2 and a lampshade 3, and an assembling component 4. In some other examples, it is possible that the frame assembly does not include the lampshade 3 or further includes other members. Besides, the ceiling lamp should further include members such as a light source panel and a light distribution element. However, these members are existing members and are not relevant to the core concept of the present disclosure so as not to be embodied in the accompanying drawings and not to be introduced in detail in the present example.

Figure 2:
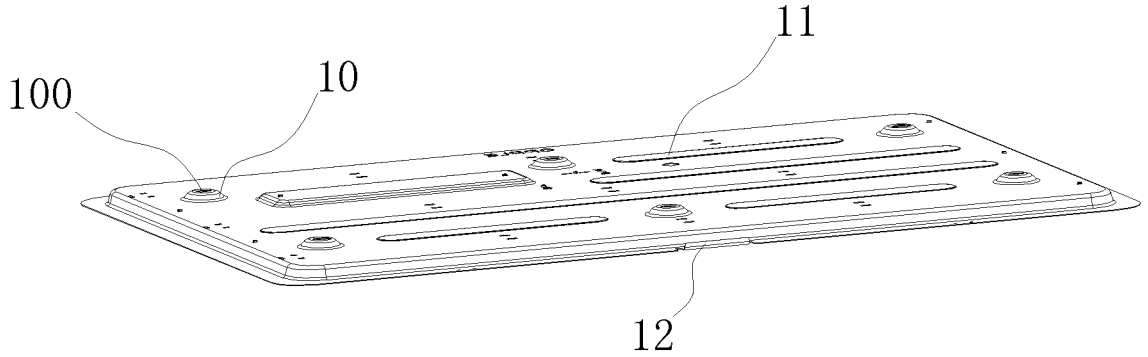
FIG. 2 is a specific structural view of a chassis disclosed in one example of the present disclosure.
Figure 3:
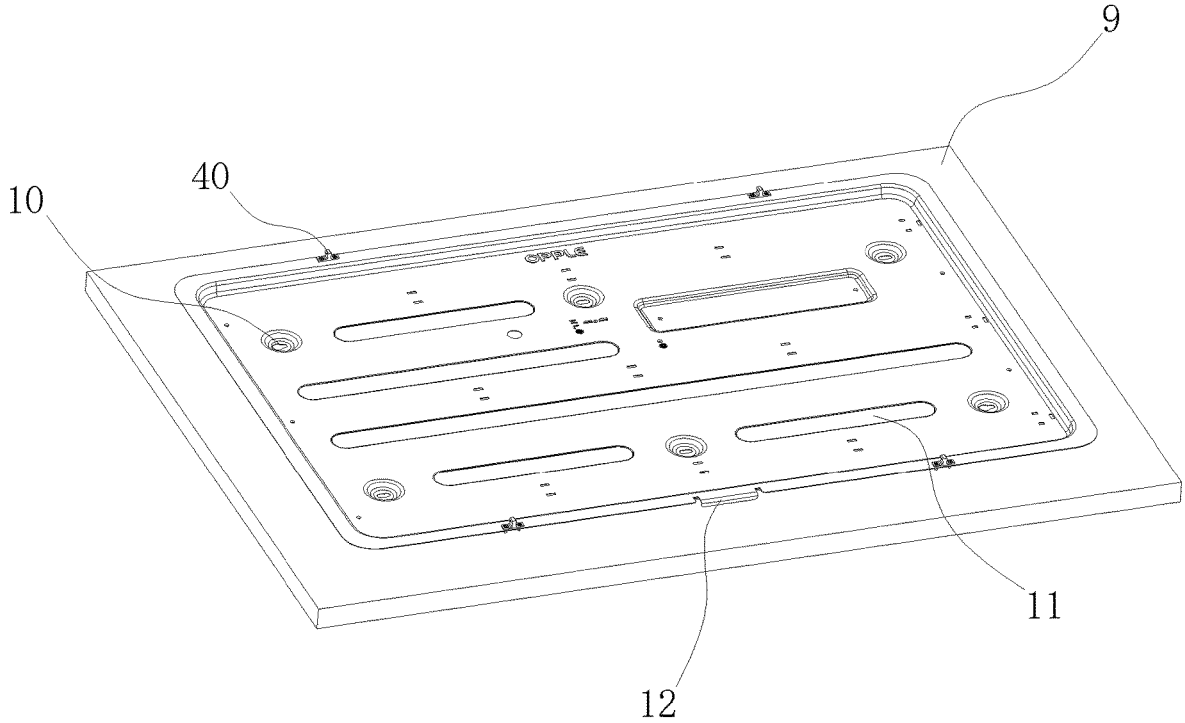
FIG. 3 is a bottom perspective view of an assembly structure of the chassis, a first assembling member and a ceiling in one example of the present disclosure.
Figure 4:
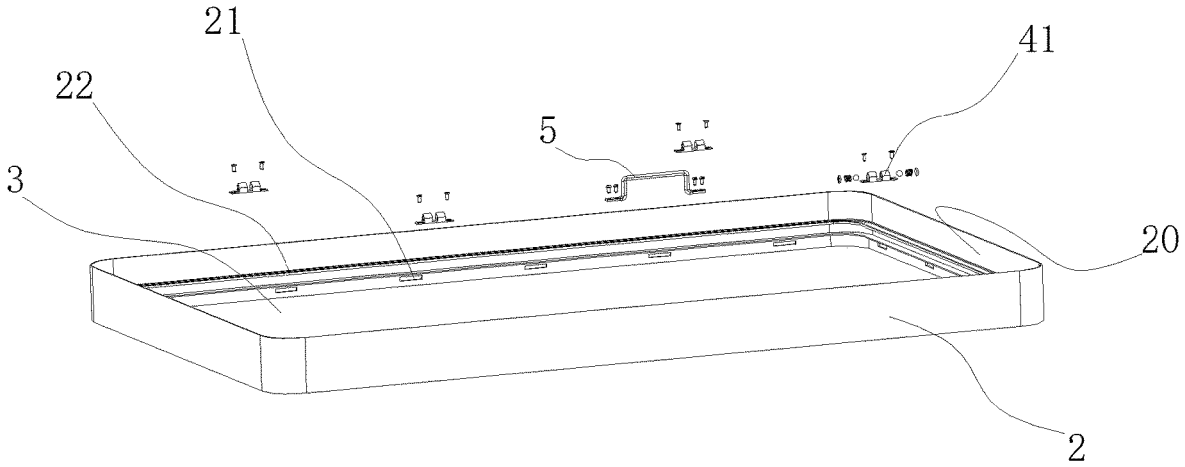
FIG. 4 is an exploded structural view of a frame, a lampshade, a hook and a second assembling member disclosed in one example of the present disclosure.
Figure 5:
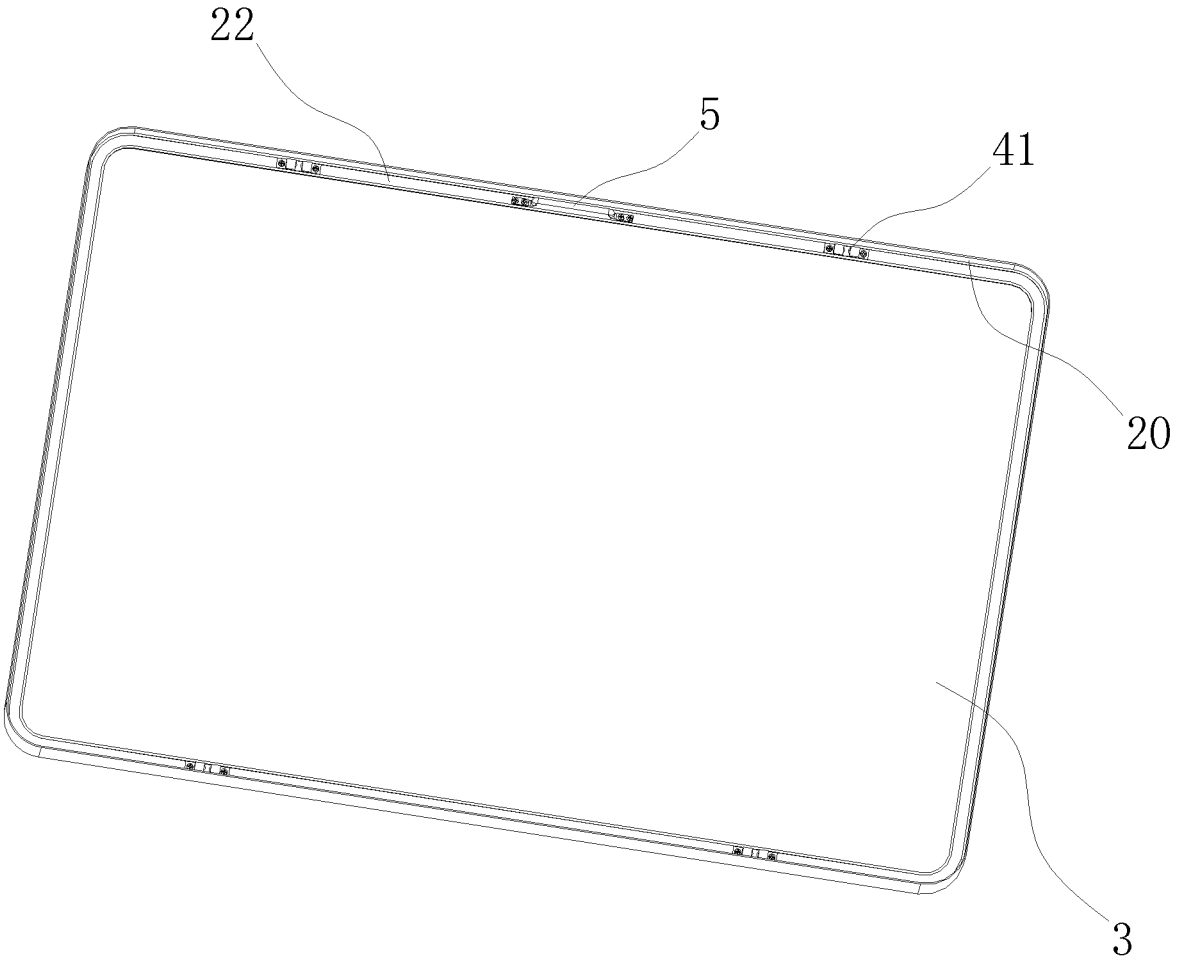
FIG. 5 is an assembly structure view of the frame, the lampshade, the hook and the second assembling member disclosed in one example of the present disclosure.

The chassis 1 in the present example is provided with an abutting surface 100 bonded to a ceiling 9, as shown in FIG. 2 and FIG. 3, the chassis 1 itself may be uneven and may have structures such as many protruded pad foots 10 and a rib 11 achieving a reinforcing or heat dissipation effect to result in surface unevenness, at the moment, the abutting surface 100 may be surfaces of the pad foots 10.

The frame 2 in the present example is generally of a circumferentially closed structure with a broad edge, the upper and lower sides of the frame 2 are open, and meanwhile, the lower side is generally provided with a circle of a flanging or a limiting member 21 which is protruded inwards to hold or fix the lampshade 3. The lampshade 3 in the present example covers the opening in the lower side of the frame 2 and is fixedly connected to the frame 2. In the present example, the frame 2 and the lampshade 3 may adopt various assembling structures which are easy to be assembled and be firm in fitting, and thus, the lampshade 3 may be made of a brittle material or other suitable material with good optical properties and anti-aging property, so that the overall service life of the lampshade 3 and the ceiling lamp is greatly prolonged. In the present example, the lampshade 3 may be put from the opening in the upper side of the frame 2 or may directly complete the fixed connection with the frame 2 when being molded.

After the fixed connection between the frame 2 and the lampshade 3 is completed, in the present example, the frame 2 covers the periphery of the chassis 1 in a vertical direction, and the frame 2 may be detachably connected to the chassis 1 by the assembling component 4 during covering. After being connected to the chassis 1 by the assembling component 4, the frame 2 will be exactly in a state of being flush with the abutting surface 100 so as to contact closely to the ceiling 9; and the chassis 1 and the assembling component 4 are also located in a region surrounded by the frame 2 and are not exposed outwards, so that the ceiling lamp may achieve a good product appearance. Therefore, the ceiling lamp provided in the present example may achieve longer service life and a good product appearance at the same time.

The assembling component adopted in the present example may include two parts. As shown in FIG. 2 to FIG. 11, the assembling component in the present example includes two parts which are respectively a first assembling member 40 and a second assembling member 41, one of the first assembling member 40 and the second assembling member 41 is arranged on the chassis 1, and the other assembling member is correspondingly arranged in the region surrounded by the frame 2, for example, it may be fixed to an inner wall 20 of the frame 2 or fixed to a specially provided fixed member 22 (such as a fixed edge strip), of course, it may also be arranged on another member of the frame 2. In the accompanying drawing of the present example, the first assembling member 40 is arranged on the chassis 1, and the second assembling member 41 is arranged on the frame 2, of course, they may also be arranged oppositely. The first assembling member 40 may be detachably connected to the second assembling member 41 in the vertical direction.

There are various detachable connection manners. In the present example, a relatively simple and convenient connection manner that the first assembling member 40 is detachably in snap-fit connection with the second assembling member 41 in the vertical direction is recommended to be used. Specifically, as shown in the figures, the first assembling member 40 in the present example includes a snap-fit main body 400 which may be of a columnar structure or another structure with a side surface parallel to the vertical direction; a snap-fit groove 400*a* is formed in the side surface, parallel to the vertical direction, of the snap-fit main body 400; and the snap-fit groove 400*a* may be of a structure with one side being only open or a structure with two sides and even three sides being open at the same time, as long as the second assembling member 41 may be in snap-fit connection. At the same time, the snap-fit main body 400 may be directly fixed to or integrated with the chassis 1 or connected to the chassis 1 by arranging a connecting sheet 401 extending in a horizontal direction in the first assembling member 40, and the connecting sheet 401 and the snap-fit main body 400 may be vertically connected to form an L or T shape arrangement.

Figure 6:
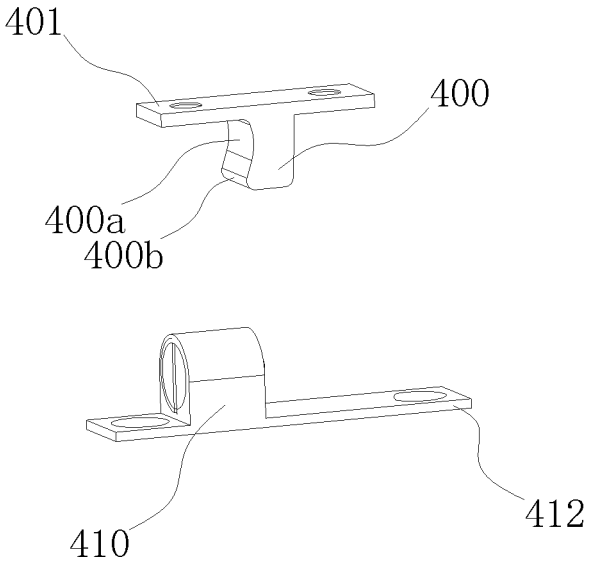
FIG. 6 and FIG. 7 are specific structural views of an assembling assembly only provided with one snap-fit groove disclosed in one example of the present disclosure, and the snap-fit grooves in FIG. 6 and FIG. 7 face opposite directions.
Figure 7:
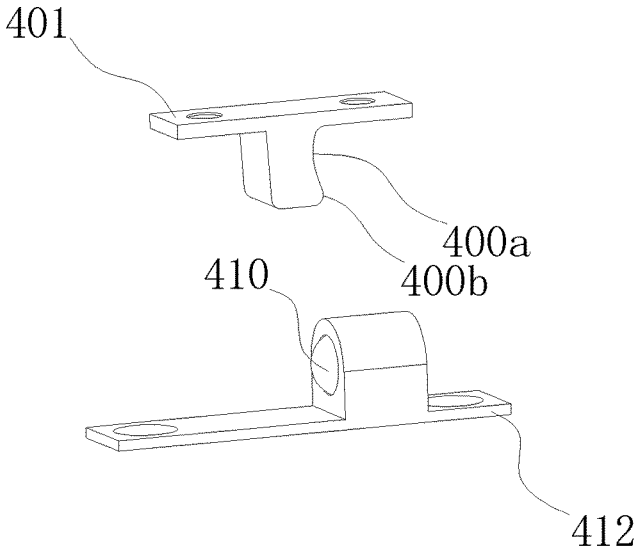
Figure 8:
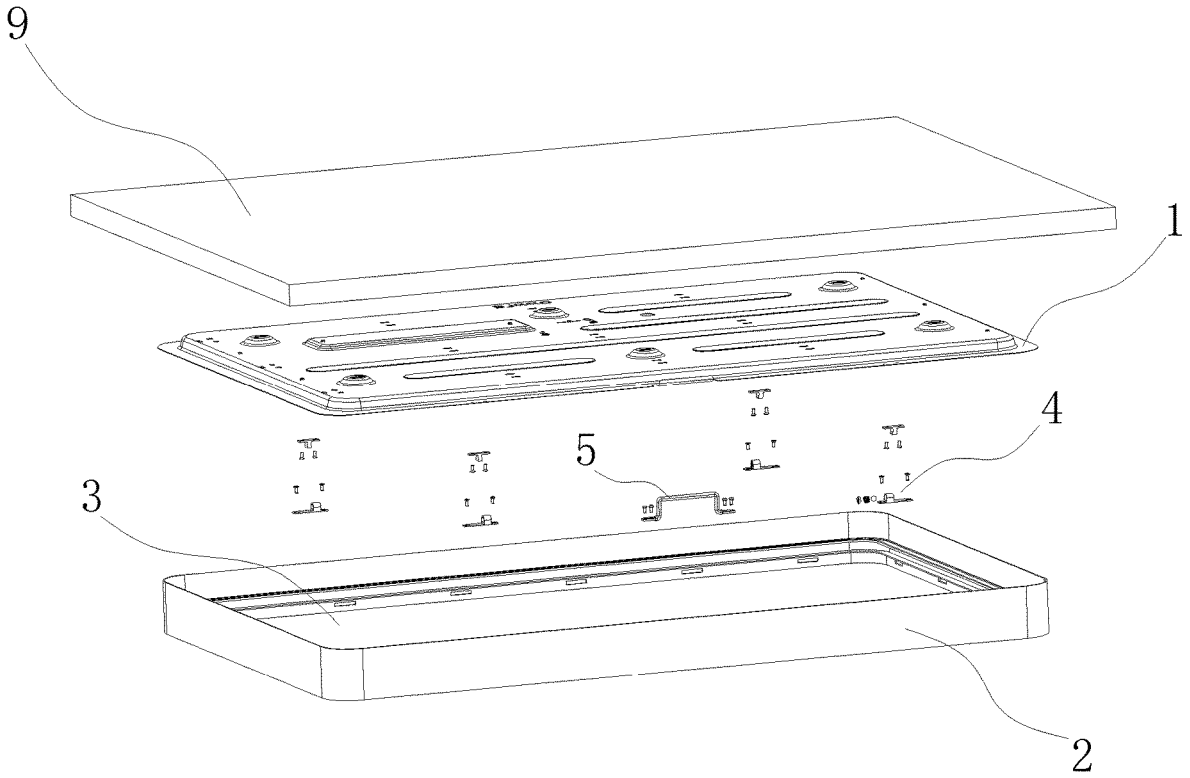
FIG. 8 and FIG. 9 are exploded structural views of a ceiling lamp provided with an assembling assembly as shown in FIG. 6 and FIG. 7 in one example of the present disclosure, wherein snap-fit grooves in two snap-fit main bodies in the same group in FIG. 8 face each other, and snap-fit grooves in two snap-fit main bodies in the same group in FIG. 9 face away from each other.
Figure 10:
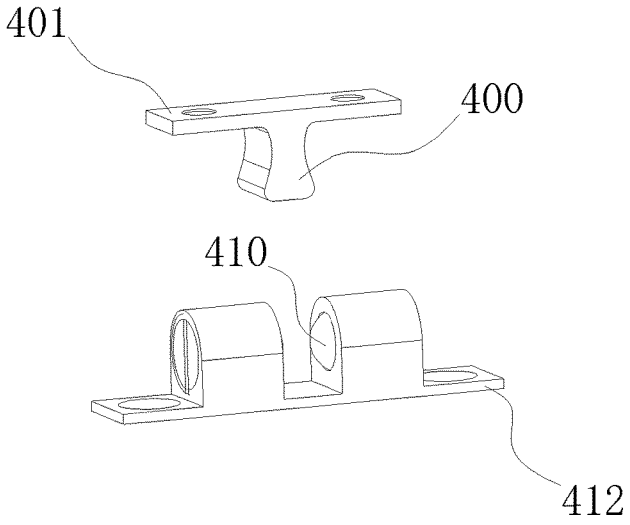
FIG. 10 is a specific structural view of an assembling assembly disclosed in one example of the present disclosure.

As shown in FIG. 6, FIG. 7 and FIG. 10, the second assembling member 41 in the present example may include an elastic snap-fit assembly 410. The elastic snap-fit assembly 410 can extend into the snap-fit groove 400*a* and apply an elastic pushing force with a horizontal component to the snap-fit groove 400*a*. The disengagement of the elastic snap-fit assembly 410 from the snap-fit groove 400*a* may be impeded by the elastic pushing force, so that the snap-fit connection between the first assembling member 40 and the second assembling member 41 is achieved. When the first assembling member 40 and the second assembling member 41 are required to be out of snap-fit connection state, the frame 2 may be pulled downwards in the vertical direction to ensure that the elastic snap-fit assembly 410 retracts from the snap-fit groove 400*a* so as to be out of snap-fit connection state.

It should be noted that in order to achieve the detachable snap-fit connection of the first assembling member 40 and the second assembling member 41 in the vertical direction, those skilled in the art will certainly adopt a structure including the snap-fit groove 400*a* and the elastic snap-fit assembly 410 by which motion in the vertical direction can be converted into motion in the horizontal direction, and there are too many structures with the corresponding functions in the related art, the descriptions thereof are omitted herein. Of course, in order to enable the elastic snap-fit assembly 410 to conveniently enter or exit from the snap-fit groove 400*a*, in the present example, for example, the snap-fit main body 400 is provided with a guide surface 400*b* for guiding the elastic snap-fit assembly 410. The guide surface 400*b* may be a plane or a curved surface and may be independent of the snap-fit groove 400*a* or integrated with the snap-fit groove 400*a*, which may be designed according to an actual demand of those skilled in the art.

In the present example, a plurality of groups of assembling members may be generally arranged between the chassis 1 and the frame 2 so as to achieve the uniform force and improve the stability of detachable connection. For each snap-fit main body 400, it may be provided with an snap-fit groove 400*a* in one side surface parallel to the vertical direction, as shown in FIG. 6 and FIG. 7. There is a horizontal interacting force between the first assembling member 40 and the second assembling member 41, and this acting force may be respectively transferred to the chassis 1 and the frame assembly. If directions of all the snap-fit grooves 400*a* are the same, an integral deviation acting force may be formed between the chassis 1 and the frame assembly. If the hardness of the material of the chassis 1 or the frame assembly is relatively lower, it is possible that deformation or displacement occurs under the deviation acting force, to make the first assembling member 40 away from the second assembling member 41 to a certain extent, and thus, the snap-fit connection effect is weakened.

In order to weaken or avoid the above-mentioned problems, the assembling components 4 in the present example may be arranged in pairs, and the two assembling components 4 in the same group are symmetrically arranged in the horizontal direction. At the same time, the snap-fit grooves 400*a* in the two snap-fit main bodies 400 in the same group further face different directions respectively. In this way, directions of acting forces of the two assembling components 4 in the same group to the chassis 1 and the frame assembly are inconsistent, so that it is very difficult to form an obvious deviation acting force between the chassis 1 and the frame assembly, and then, the snap-fit connection effect is ensured.

Figure 9:
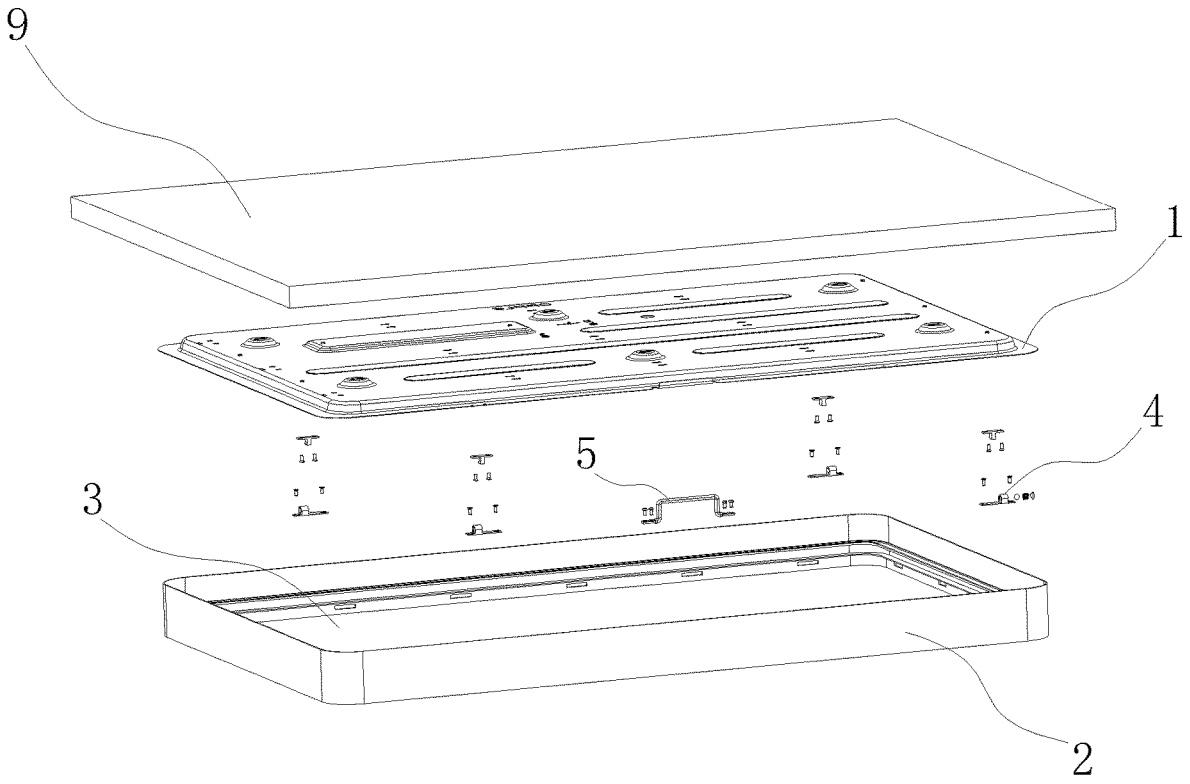

In a more preferred solution, the snap-fit grooves 400*a* in the two snap-fit main bodies 400 in the same group may be arranged to face each other (referring to FIG. 8) or face away from each other (referring to FIG. 9). The both manners may ensure that the directions of the acting forces of the two assembling components 4 in the same group to the chassis 1 and the frame assembly are opposite, and the acting forces are offset each other, so that the deviation acting force is scarcely formed between the chassis 1 and the frame assembly, and then, the snap-fit connection effect is better. Further, the elastic pushing forces which are acted on the two snap-fit members 410*b* in the same group are preferably in a horizontal direction and are on the same straight line or parallel to each other, so that influences on the chassis 1 are further reduced.

In addition to the above-mentioned manners, the snap-fit grooves 400*a* may also be arranged in two sides, facing away from each other, of each of the snap-fit main bodies 400 at the same time, the snap-fit groove 400*a* in each side is correspondingly provided with one elastic snap-fit assembly 410, and then, two sides of each of the snap-fit main bodies 400 are acted by horizontal pushing forces of the elastic elastic snap-fit assemblies 410 at the same time, so that the forces within the assembling components 4 are substantially balanced, almost no additional horizontal acting force is applied to the chassis 1 and the frame assembly.

Figure 11:
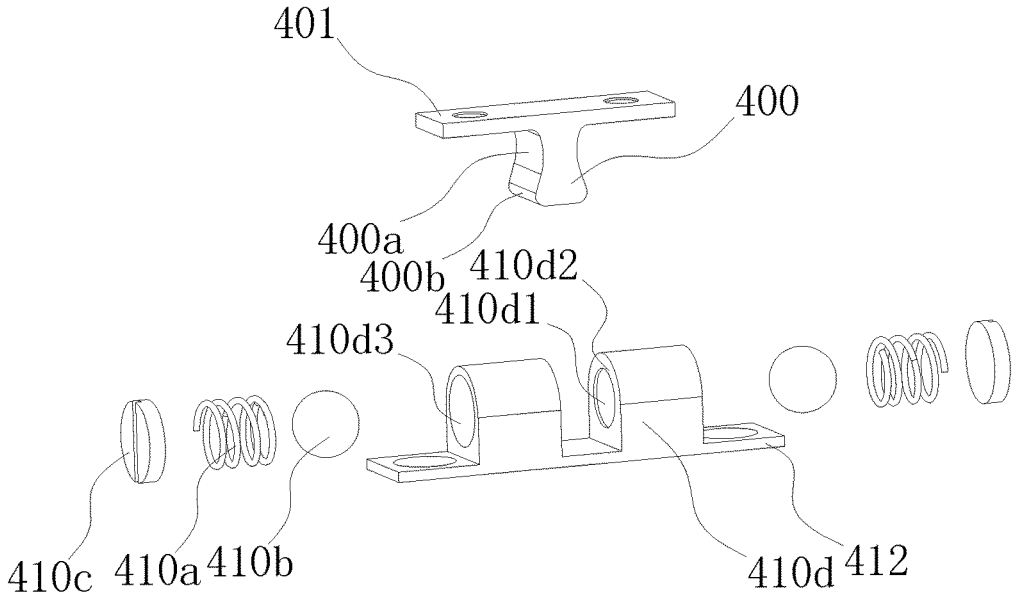
FIG. 11 is an exploded structural view of an assembling assembly disclosed in one example of the present disclosure.
Figure 12:
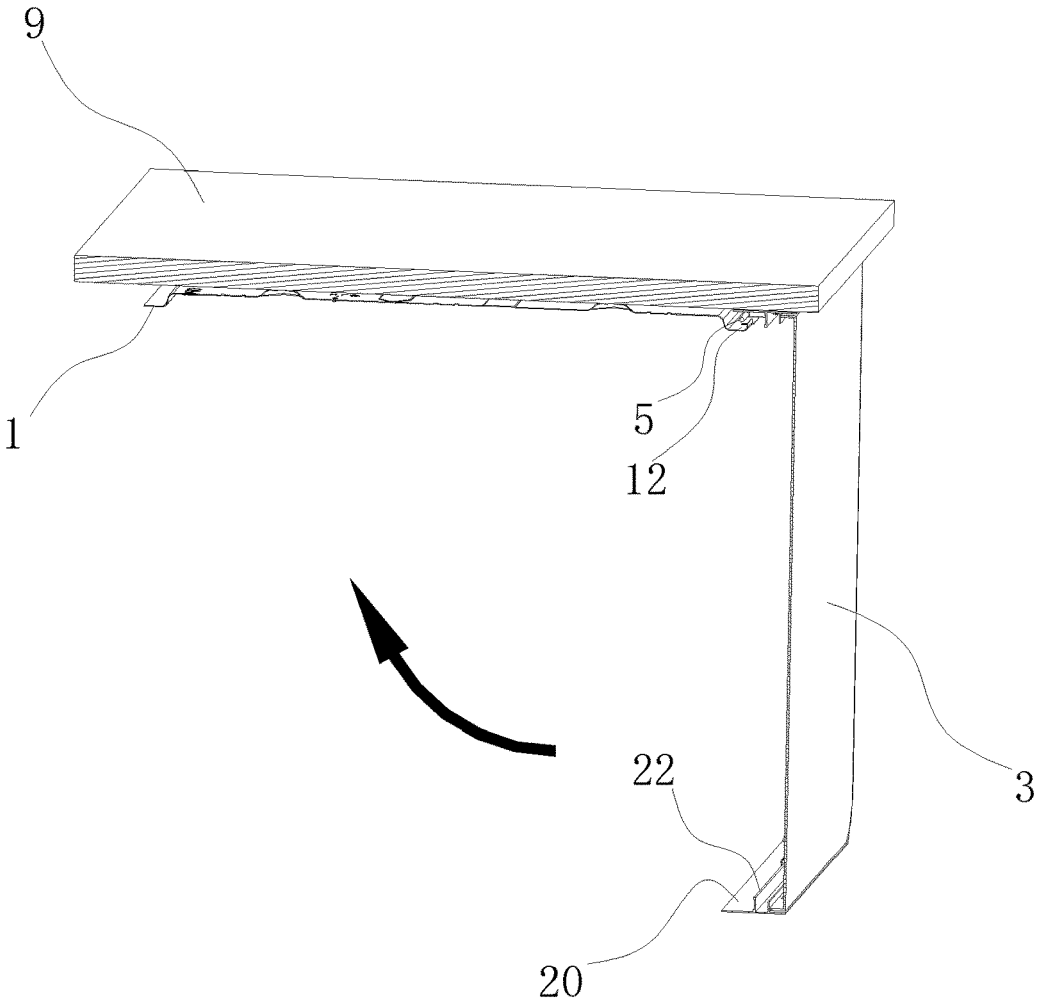
FIG. 12 is a schematic view (cross-sectional view) showing rotation of the frame and the chassis disclosed in one example of the present disclosure.

Further reference is made to FIG. 6, FIG. 7, FIG. 10 and FIG. 11, the elastic snap-fit assembly 410 in the present example may include an elastic element 410*a*, a snap-fit member 410*b* and a sliding base 410*d*, and the elastic snap-fit assembly 410 may be directly fixed to or integrated with the frame 2 or arranged on a fixed main body 412 and then fixed to the frame 2 by means of the fixed main body 412. The sliding base 410*d* in the present example is used for limiting a protrusion direction of the snap-fit member 410*b*, and the sliding base 410*d* has many implementation structures, such as a sliding chute and a sliding rail. As shown in FIG. 11, the sliding base 410*d* in the present example is in a form of a limiting cavity, and the limiting cavity 410*d* (for facilitating description, the numeral of the sliding base continues to be used below) may be provided with a protrusion opening 410*d*1 facing the snap-fit groove 400*a*. The elastic element 410*a* and the snap-fit member 410*b* are both arranged in the limiting cavity 410*d*, wherein the snap-fit member 410*b* and the limiting cavity 410*d* may relatively slide, and the snap-fit member 410*b* may slide under the pushing of the elastic element 410*a* to protrude out of the protrusion opening 410*d*1. Further, in a preferred solution, the limiting cavity 410*d* is further provided with a limiting body 410*d*2 arranged around the protrusion opening 410*d*1, at the moment, the limiting body 410*d*2 can prevent the snap-fit member 410*b* from separating from the limiting cavity 410*d* via the protrusion opening 410*d*1, that is, at the moment, the snap-fit member 410*b* is limited between the limiting body 410*d*2 and the elastic element 410*a*, only a portion may protrude out of the protrusion opening 410*d*1, and this portion may be in snap-fit connection with the snap-fit groove 400*a*. Such design may ensure that the elastic snap-fit assembly 410 has a fixed position and the snap-fit connection degree, so that it is convenient to control a snap-fit connection state. The limiting body 410*d*2 in the present example may be a circle of flanging or a plurality of limiting parts surrounding the protrusion opening 410*d*1 as long as the snap-fit member 410*b* can be prevented from separating from the limiting cavity 410*d* via the protrusion opening 410*d*1. The elastic element 410*a* in the present example may adopt various possibly suitable elastic members such as a spring, a V-shaped or wavy-shaped spring strip and an elastic rubber block. The snap-fit member 410*b* preferably adopts a ball which is not only good in guide effect, but also easy to be assembled, and the snap-fit member 410*b* may also adopt a bullet structure.

As shown in FIG. 11, on this basis, an inlet 410*d*3 may be further formed in an end, away from the protrusion opening 410*d*1, of the limiting cavity 410*d* in the present example, and the snap-fit member 410*b* and the elastic element 410*a* may be put in the limiting cavity 410*d* at one time via the inlet 410*d*3. The edge of the inlet 410*d*3 is provided with a screw thread, meanwhile, the elastic snap-fit assembly 410 may further include a threaded end cover 410*c* which is used to close the inlet 410*d*3 and is fixed by threaded connection with the limiting cavity 410*d* after the snap-fit member 410*b* and the elastic element 410*a* are put in the limiting cavity 410*d*, and the elastic element 410*a* is also abutted with the threaded end cover 410*c*.

In this way, by rotating the threaded end cover 410*c*, the position of the threaded end cover 410*c* may be adjusted, then, a compression state of the elastic element 410*a* is adjusted, and thus, an elastic force acting on the snap-fit member 410*b* is changed. The elastic force acting on the snap-fit member 410*b* further affects a force used when the frame 2 and the chassis 1 are assembled and disassembled. Particularly, when the elastic element 410*a* is aged to result in reduction of the elastic force, the elastic element 410*a* may supply a sufficient elastic force to the snap-fit member 410*b* again by adjusting the threaded end cover 410*c*, so that the phenomenon that the snap-fit member 410*b* retracts by itself due to being unable to overcome the gravity of the frame 2 and the lampshade 3 is avoided, and the service life of the ceiling lamp is prolonged.

When the snap-fit grooves 400*a* are arranged in the two sides, facing away from each other, of the snap-fit main body 400 at the same time, the two elastic snap-fit assemblies 410 may be arranged on one fixed main body 412 at the same time. The protrusion openings 410*d*1 of the two elastic snap-fit assemblies 410 are arranged oppositely, and a gap allowing the snap-fit main body 400 to enter is retained between the two protrusion openings, in this way, the snap-fit main body 400 may be in snap-fit connection with the elastic snap-fit assemblies 410 on the two sides at the same time when entering the gap.

Although the frame 2 and the chassis 1 in the present example are assembled by the assembling component 4, the disassembling/assembling directions of the assembling component 4 are the vertical direction and are consistent with the gravity direction of the frame 2, and therefore, the frame 2 is very easy to fall off once the assembling component 4 is aged and damaged or other cases occur, if minor, it may cause damage of the frame 2 and the lampshade 3, if severe, personnel may be injured.

In order to prevent the frame 2 from directly falling off, as shown in FIG. 2, FIG. 4, FIG. 5, FIG. 8, FIG. 9 and FIG. 12, one side of the chassis 1 in the present example may be rotatably connected to one side in the region surrounded by the frame 2, a rotating shaft thereof is parallel to a horizontal plane, and the frame 2 may change from being located below the chassis 1 to cover the periphery of the chassis 1 by rotation. In this way, the frame 2 may be connected to the chassis 1 in two manners at the same time, and they not only may be rotatably connected, but also may be detachably connected by the assembling component 4. When the assembling component 4 suddenly fails for some reason, the frame 2 and the chassis 1 are still kept in a rotatable connection state, so that the frame 2 and the lampshade 3 may not directly fall off, but may rotate around the rotating shaft until they are basically vertical, thereby reminding a user of performing maintenance.

Specifically, a hooking part 12 may be arranged on a side of the chassis 1. The hooking part 12 further includes a hook 5 on the ceiling lamp, the hook 5 is connected to a side in the region surrounded by the frame 2 and may be fixedly or rotatably connected to the frame 2, and the hook 5 may be fixed to an inner wall 20 of the frame 2, or fixed to a fixed member 22 (such as a fixed edge strip) or arranged on other fixed structures. The frame 2 is rotatably hooked with the hooking part 12 by the hook 5. By adopting such a design, not only is the structure simple, but also the assembling is easier.

Examples of the present disclosure provides a ceiling lamp, comprising a chassis, a frame assembly and an assembling assembly;

the chassis is provided with an abutting surface bonded to a ceiling, and the frame assembly is detachably connected to the chassis in a vertical direction by the assembling assembly;

the assembling assembly comprises a first assembling member and a second assembling member, one of the first assembling member and the second assembling member is arranged on the chassis, and the other assembling member is correspondingly arranged on the frame assembly; the first assembling member comprises a snap-fit main body, the second assembling member comprises an elastic snap-fit assembly, and the elastic snap-fit assembly comprises a sliding base, an elastic element and a snap-fit member;

a snap-fit groove is arranged in a side surface parallel to the vertical direction of the snap-fit main body, the snap-fit member is slidably arranged on the sliding base and is capable of protruding out of the sliding base to extend into the snap-fit groove, and the elastic element supplies an elastic pushing force for the snap-fit member to extend into the snap-fit groove.

Optionally, in the above ceiling lamp, the snap-fit groove is arranged in one side of the snap-fit main body; and two assembling assemblies form one group, each of the two assembling assemblies is the assembling assembly, and the snap-fit grooves in the two snap-fit main bodies in a same group face each other or face away from each other.

Optionally, in the above ceiling lamp, the elastic pushing forces acted on the two snap-fit members in the same group are in a horizontal direction, and are located on a same straight line or parallel to each other.

Optionally, in the above ceiling lamp, the snap-fit grooves are formed in two sides facing away from each other of the snap-fit main body, each of the snap-fit grooves is the snap-fit groove, and the snap-fit groove in each of the two sides is correspondingly provided with one elastic snap-fit assembly.

Optionally, in the above ceiling lamp, the first assembling member further comprises a connecting sheet which is configured to connect to the chassis/the frame assembly, and the snap-fit main body is vertically connected to the connecting sheet.

Optionally, in the above ceiling lamp, the snap-fit main body is provided with a guide surface for guiding the snap-fit member to enter or exit from the snap-fit groove.

Optionally, in the above ceiling lamp, the sliding base is a limiting cavity, and the limiting cavity is provided with a protrusion opening facing the snap-fit groove;

the snap-fit member and the elastic element are arranged in the limiting cavity, and the snap-fit member is capable of protruding out of the protrusion opening under pushing of the elastic pushing force;

a portion protruding out of the protrusion opening of the snap-fit member is in snap-fit connection with the snap-fit groove.

Optionally, in the above ceiling lamp, an inlet is provided in an end away from the protrusion opening of the limiting cavity, an edge of the inlet is provided with a screw thread, the snap-fit member further comprises a threaded end cover, the threaded end cover is configured to close the inlet and is fixed by threaded connection with the limiting cavity, and the elastic element is abutted with the threaded end cover.

Optionally, in the above ceiling lamp, the second assembling member further comprises a fixed main body which is connected to the chassis/the frame assembly, and the sliding base is arranged on the fixed main body.

Optionally, in the above ceiling lamp, the snap-fit member is a ball, and the elastic element is a spring.

The ceiling lamp disclosed in the example of the present disclosure can greatly simplify the disassembling/assembling steps of the frame assembly and save the time because the frame assembly is detachably connected to the chassis in a vertical direction by using the assembling assembly.

In summary, by using the ceiling lamp provided in the example of the present disclosure, the disassembling/assembling steps of the frame assembly can be greatly simplified, and the time is saved.

Differences of all the examples are mainly described in the above example of the present disclosure, different optimized characteristics of all the examples may be combined to form a better example as long as no contradiction arises, and for the sake of brevity, it will not be described in detail herein.

What are described above is related to the specific examples of the present disclosure only and not limitative to the scope of the present disclosure. For those skilled in the art, the present disclosure may have various changes and modifications. Any modification, equivalent replacement, improvement and the like made within the spirit and principle of the present disclosure shall be included within the scope of the claims of the present disclosure

The invention claimed is:

1. A ceiling lamp, comprising a chassis, a frame assembly and an assembling assembly, wherein the chassis is provided with an abutting surface bonded to a ceiling, and the frame assembly is detachably connected to the chassis in a vertical direction by the assembling assembly;

the assembling assembly comprises a first assembling member and a second assembling member, one of the first assembling member and the second assembling member is arranged on the chassis, and the other assembling member is correspondingly arranged on the frame assembly;

the first assembling member comprises a snap-fit main body, the second assembling member comprises an elastic snap-fit assembly, and the elastic snap-fit assembly comprises a sliding base, an elastic element and a snap-fit member; and a snap-fit groove is arranged in a side surface parallel to the vertical direction of the snap-fit main body, the snap-fit member is slidably arranged on the sliding base and is capable of protruding out of the sliding base to extend into the snap-fit groove, and the elastic element supplies an elastic pushing force for the snap-fit member to extend into the snap-fit groove;

wherein the snap-fit main body is provided with a guide surface for guiding the snap-fit member to enter or exit from the snap-fit groove, wherein the guide surface is a curved surface to achieve a detachable snap-fit connection and is independent of the snap-fit groove.

2. The ceiling lamp according to claim 1, wherein the snap-fit groove is arranged in one side of the snap-fit main body; and two assembling assemblies form one group, each of the two assembling assemblies is the assembling assembly, and the snap-fit grooves in the two snap-fit main bodies in a same group face each other or face away from each other.

3. The ceiling lamp according to claim 2, wherein the elastic pushing forces acted on the two snap-fit members in the same group are in a horizontal direction, and are located on a same straight line or parallel to each other.

4. The ceiling lamp according to claim 1, wherein snap-fit grooves are formed in two sides facing away from each other of the snap-fit main body, each of the snap-fit grooves is the snap-fit groove, and the snap-fit groove in each of the two sides is correspondingly provided with one elastic snap-fit assembly.

5. The ceiling lamp according to claim 1, wherein the first assembling member further comprises a connecting sheet which is configured to connect to the chassis/the frame assembly, and the snap-fit main body is vertically connected to the connecting sheet.

6. The ceiling lamp according to claim 1, wherein the sliding base is a limiting cavity, and the limiting cavity is provided with a protrusion opening facing the snap-fit groove;

the snap-fit member and the elastic element are arranged in the limiting cavity, and the snap-fit member is capable of protruding out of the protrusion opening under pushing of the elastic pushing force; and a portion protruding out of the protrusion opening of the snap-fit member is in snap-fit connection with the snap-fit groove.

7. The ceiling lamp according to claim 6, wherein an inlet is provided in an end away from the protrusion opening of the limiting cavity, an edge of the inlet is provided with a screw thread, the snap-fit member further comprises a threaded end cover, the threaded end cover is configured to close the inlet and is fixed by threaded connection with the limiting cavity, and the elastic element is abutted with the threaded end cover.

8. The ceiling lamp according to claim 6, wherein the snap-fit member is a ball, and the elastic element is a spring.

9. The ceiling lamp according to claim 1, wherein the second assembling member further comprises a fixed main body which is connected to the chassis/the frame assembly, and the sliding base is arranged on the fixed main body.

* * * * *